US010004365B2

(12) United States Patent
Hutchinson

(10) Patent No.: US 10,004,365 B2
(45) Date of Patent: Jun. 26, 2018

(54) TOILET PAPER ROLL REPLACEMENT DEVICE

(75) Inventor: Corey Claude Hutchinson, Missouri City, TX (US)

(73) Assignee: Corey Claude Hutchinson, Missouri City, TX (US)

( * ) Notice: Subject to any disclaimer, the term of this patent is extended or adjusted under 35 U.S.C. 154(b) by 0 days. days.

(21) Appl. No.: 13/603,024

(22) Filed: Sep. 4, 2012

(65) Prior Publication Data

US 2013/0062453 A1 Mar. 14, 2013

Related U.S. Application Data

(60) Provisional application No. 61/533,799, filed on Sep. 13, 2011.

(51) Int. Cl.
*A47K 10/40* (2006.01)

(52) U.S. Cl.
CPC ..... *A47K 10/40* (2013.01)

(58) Field of Classification Search
CPC ..... A47K 10/22; A47K 10/32; A47K 10/38; A47K 10/40; A47K 10/405; A47K 2010/3233; A47K 10/3854; A47K 10/3681
USPC ..... 242/598.2, 598.3, 598.6, 599.1, 599.3
See application file for complete search history.

(56) References Cited

U.S. PATENT DOCUMENTS

| | | | | | |
|---|---|---|---|---|---|
| 1,399,432 | A * | 12/1921 | Johnson | A47K 10/22 | 242/423.1 |
| 2,522,109 | A * | 9/1950 | Foltis | 242/599.3 | |
| 3,156,425 | A * | 11/1964 | Mynchenberg | 242/590 | |
| 3,464,568 | A * | 9/1969 | Hexter | 211/105.6 | |
| 5,467,935 | A * | 11/1995 | Moody | A47K 10/40 | 242/422.4 |
| 6,572,051 | B1 * | 6/2003 | Stude | 242/598.2 | |
| 2002/0096597 | A1 * | 7/2002 | Adelakun | 242/588.6 | |
| 2010/0187351 | A1 * | 7/2010 | Billman | 242/599 | |
| 2011/0101152 | A1 * | 5/2011 | Molstad | 242/606 | |

* cited by examiner

*Primary Examiner* — Michael R Mansen
*Assistant Examiner* — Nathaniel L Adams
(74) *Attorney, Agent, or Firm* — Corey Claude Hutchinson

(57) ABSTRACT

A removable tube structure comprising of a tube and a plate conjoined to one end of the tube, whereby the plate having a hole in the center, of the same diameter as the inside diameter of tube, allows for removable mounting of the tube structure onto and over one end of a two telescoping tube toilet paper roll mandrel assembly, and the plate having an area extending radially outward, whereby the plate can be contacted by an empty or full toilet paper roll being pushed axially towards the plate by at least one finger of a user, which actuates the removable tube structure and compresses the telescoping tubes of the mandrel assembly, in order to remove and replace the roll of toilet paper, and the associated telescoping tube mandrel assembly, from a mandrel assembly holder.

6 Claims, 2 Drawing Sheets

TOILET PAPER ROLL REPLACEMENT DEVICE

This application claims the benefit of Provisional Application No. 61/533,799, filed Sep. 13, 2011.

REFERENCES CITED

| U.S. Patent Documents | | |
|---|---|---|
| 1,045,311 | November 1912 | Moberg |
| 2,253,664 | August 1941 | Vigo |
| 2,434,556 | January 1948 | Foltis |
| 2,486,607 | November 1949 | Laystrom et al. |
| 2,522,109 | September 1950 | Foltis |
| 2,639,939 | May 1953 | Matchett |
| 2,801,809 | August 1957 | Glaner |
| 2,873,928 | February 1959 | Klasky |
| 2,889,122 | June 1959 | McConnell |
| 3,037,718 | June 1962 | Pettit |
| 3,239,158 | March 1966 | Levesque |
| 3,362,653 | January 1968 | Carlisle |
| 3,392,928 | July 1968 | Peterson |
| 3,633,838 | January 1972 | Krueger |
| 3,643,884 | February 1972 | Curtin |
| 4,191,342 | March 1980 | Reinhold |
| 4,383,656 | May 1983 | Campbell |
| D296963 | August 1988 | Smallwood |
| 5,381,984 | January 1995 | Hindsgual |
| 5,494,218 | February 1996 | Armand |
| 5,598,987 | February 1997 | Wachowicz |
| 5,727,751 | March 1998 | Liu |
| D405305 | February 1999 | Hobgood |
| 6,431,493 | August 2002 | Stauner |
| 6,572,051 | June, 2003 | Stude |

BACKGROUND OF THE INVENTION

1. Field of the Invention

The present invention relates to a device to accommodate the replacement of a roll of toilet paper held on a telescoping tube mandrel assembly nominally made of three parts, where one part is a tube that is axially opposed to and inserted into another tube, and a spring located between them that biases the tubes away from each other. The toilet paper roll replacement device of the present invention allows replacement of the toilet paper roll by moving one tube axially toward the other tube compressing the spring between them, whereby a user can remove and replace the telescoping tube mandrel assembly with the roll of toilet paper from, and back into, the mandrel assembly holder, respectively.

2. Description of the Prior Art

Up to this time, various devices have been proposed for removing and replacing a roll of toilet paper from a mandrel assembly and holder. They have been developed as a standalone part or an embodied part of a telescoping tube mandrel assembly, which may be inclusive of a radially outward extending flange, tab, or protrusion from one of the tubes, that permits the moving of one tube towards the other tube of the telescoping tube mandrel assembly. The standalone prior structures can be removably mounted to a conventional toilet paper roll telescoping tube mandrel assembly. Prior structures embodied as part of the telescoping tube mandrel assembly require one or both of the telescoping tubes to be made of a special construction.

Some previously proposed roll of paper replacement devices and/or telescoping tube mandrel assemblies for mounting and/or replacing a roll of toilet paper are declared in the following U.S. Patents:

U.S. Pat. No. 6,572,051 Stude; U.S. Pat. No. 2,434,556 Foltis; U.S. Pat. No. 2,486,607 Laystrom et al.; U.S. Pat. No. 2,522,109 Foltis; U.S. Pat. No. 3,239,158 Levesque; U.S. Pat. No. 3,392,928 Peterson; U.S. Pat. No. 3,643,884 Curtin; U.S. Pat. No. 4,191,342 Reinhold; U.S. Pat. No. 5,494,218 Armand Des.; 296,963 Smallwood Des.; 405,305 Hobgood.

BRIEF SUMMARY OF THE INVENTION

According to the present invention there is provided for use, a removable tube structure comprising of a tube and a plate at one end of tube, both of a certain thickness, made with inner and outer surfaces, whereby the plate having a hole in the center of the same diameter as the inner diameter of tube to allow removable mounting of the tube structure onto and over one end, nominally the larger end, of the two telescoping tubes of a toilet paper roll mandrel assembly, and the plate having an area extending radially outward, whereby the plate can be contacted by an empty or full toilet paper roll that is pushed axially with at least one finger of the user, actuating the removable tube structure, which compresses the telescoping tubes of the mandrel assembly to remove and replace a roll of toilet paper, and the telescoping tube mandrel assembly, from the mandrel assembly holder.

DETAILED DESCRIPTION OF THE INVENTION

Figure 1:
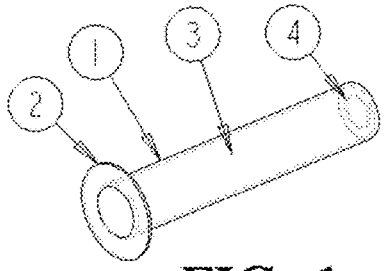
FIG. 1 is a perspective view of a structure of the standalone present invention, with the plate end of the structure in the forefront of the view.
Figure 2:
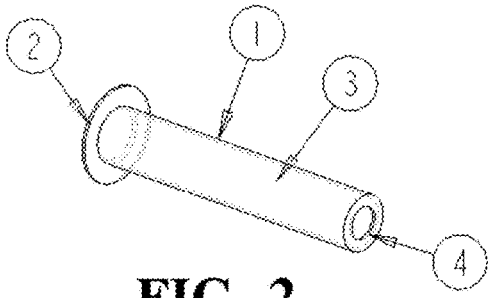
FIG. 2 is a perspective view of a structure of the standalone present invention, with the tube end of the structure in the forefront of the view.
Figure 3:
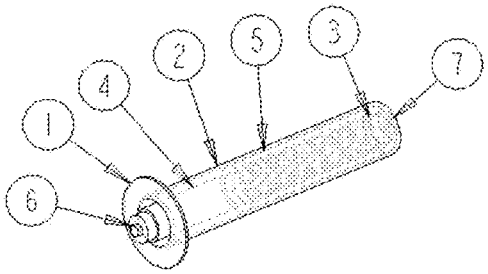
FIG. 3 is a perspective view of a structure of the present invention mounted over one end of a conventional telescoping tube mandrel assembly used for mounting a toilet paper roll, with the plate end of the structure in the forefront of the view; The telescoping tubes of the mandrel assembly, which is not part of the present invention, is a conventional structure, whereby it consists of a compression spring, located inside and between a smaller tube and a larger tube, and biases the tubes axially away from each other.
Figure 4:
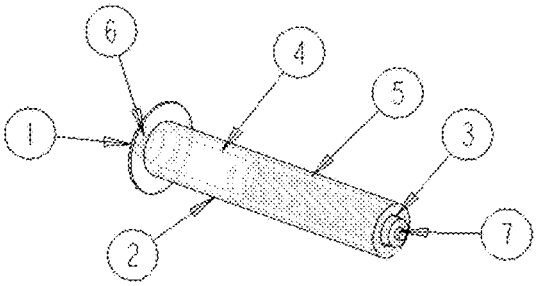
FIG. 4 is a perspective view of a structure of the present invention mounted over one end of a conventional telescoping tube mandrel assembly, with the tube end of the structure in the forefront of the view.
Figure 5:
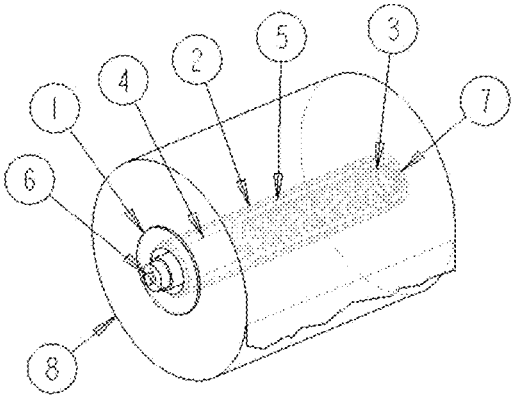
FIG. 5 is a perspective view of the structure of the present invention mounted over one end of a conventional telescoping tube mandrel assembly, and a roll of toilet paper positioned on the present invention in the nominal configuration; the plate end of the structure is in the forefront of the view.
Figure 6:
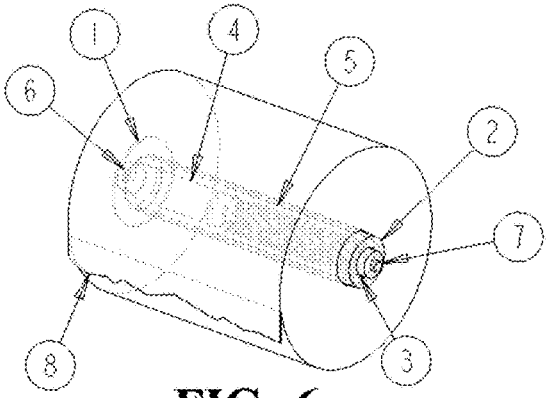
FIG. 6 is a perspective plan view of the structure of the present invention mounted over one end of a conventional telescoping tube mandrel assembly, and a roll of toilet paper positioned on the present invention in the nominal configuration; the tube end of the structure is in the forefront of the view.
Figure 7:
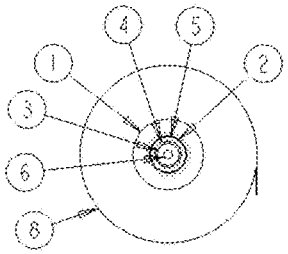
FIG. 7 is a left side plan view of the structure of the present invention mounted over one end of a conventional telescoping tube mandrel assembly, and a roll of toilet paper positioned on the present invention in the nominal configuration.
Figure 8:
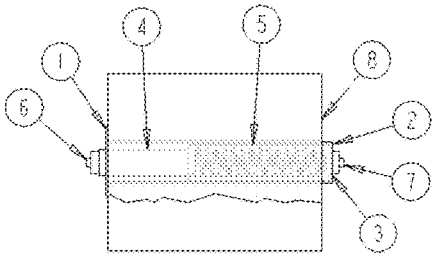
FIG. 8 is a front plan view of the structure of the present invention mounted over one end of a conventional telescoping tube mandrel assembly, and a roll of toilet paper positioned on the present invention in the nominal configuration.
Figure 9:
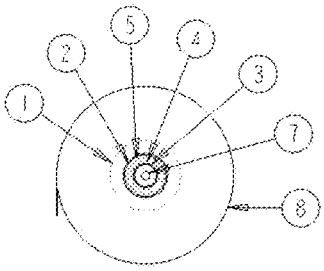
FIG. 9 is a right side plan view of the structure of the present invention mounted over one end of a conventional telescoping tube mandrel assembly, and a roll of toilet paper positioned on the present invention in the nominal configuration.
Figure 10:
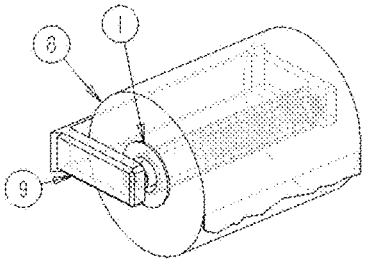
FIG. 10 is a perspective view of the structure of the present invention mounted over one end of a conventional telescoping tube mandrel assembly, which is assembled to a conventional mandrel assembly holder attached to a wall or alternate surface, with a roll of toilet paper positioned on the present invention in the nominal configuration; the plate end of the structure is in the forefront of the view; The mandrel assembly holder, which is not part of the present invention, is a conventional structure, consisting of a base attached to a wall or alternate surface, and two outwardly extending legs, whereby each leg has a hole or provision for the installation of a stepped shoulder of a conventional telescoping tube mandrel assembly, and is not part of the present invention.
Figure 11:
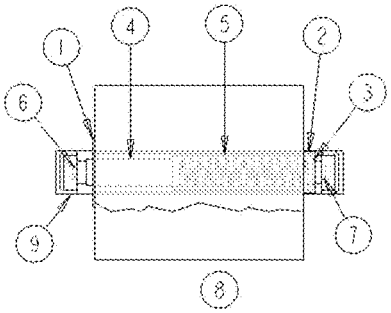
FIG. 11 is a front plan view of the structure of the present invention mounted over one end of a conventional telescoping tube mandrel assembly, which is assembled to a conventional mandrel assembly holder attached to a wall or alternate surface, with a roll of toilet paper positioned on the present invention in the nominal configuration.
Figure 12:
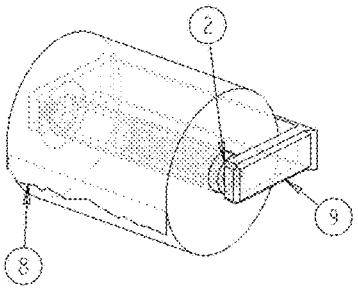
FIG. 12 is a perspective view of the structure of the present invention mounted over one end of a conventional telescoping tube mandrel assembly, which is assembled to a conventional mandrel assembly holder attached to a wall or alternate surface, with a roll of toilet paper positioned on the present invention in the nominal configuration; the tube end of the structure is in the forefront of the view.
Figure 13:
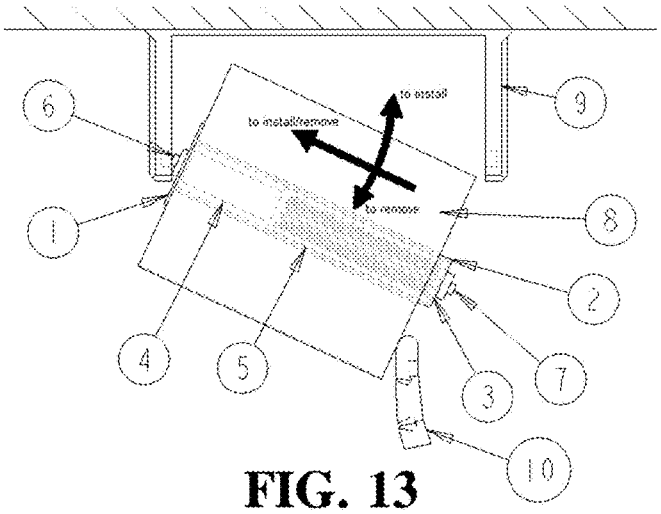
FIG. 13 is a top plan view of the structure of the present invention mounted over one end of a conventional telescoping tube mandrel assembly, being installed with a roll of toilet paper on the structure of the present invention, in a conventional mandrel assembly holder attached to a wall or alternate surface, by using at least one finger of a user to push the toilet paper against the plate end of the structure of the present invention, which actuates the structure of the present invention, and therefore compresses the telescoping tube mandrel assembly with the present invention and roll of toilet paper towards one leg of the mandrel assembly holder, consequently and thereafter facilitating the replacement or removal of a roll of toilet paper, when the telescoping tube mandrel assembly is removed.

The utility of the present invention begins with the FIG. 1 drawing, depicting the removable tube structure 1 comprising of a tube 2 and a plate 3 conjoined to one end of the tube.

The plate 3 of the removable tube structure 1 having a hole 4 in the center, allows the removable tube structure 1 to be mounted to the telescoping tube mandrel assembly 6 by positioning the plate 3 end of removable tube structure 1 onto and over either the smaller tube 7 or, nominally, the larger tube 8 of the telescoping tube mandrel assembly 6, and sliding the removable tube structure 1 over a majority of the remaining construction of the telescoping tube mandrel assembly 6, whereby the hole 5 in the tube 2 end of the removable tube structure 1 is positioned over and onto the stepped shoulder 9 or 10 of either the smaller tube 7 or, nominally, the larger tube 8 of the telescoping tube mandrel assembly 6.

A full toilet paper roll 11 is positioned over and onto the tube 2 end of the removable tube structure 1, as it is over and onto the telescoping tube mandrel assembly 6, forming an assembly whereby the user positions the stepped shoulder 9 of the telescoping tube mandrel assembly 6, at the plate 3 end of the removable tube structure 1, into the hole 14 of one leg 13 of the mandrel assembly holder 12 at an angle, and utilizes at least one finger 17 to push the toilet paper roll 11 axially against the radially outward extending plate 3 of the removable tube structure 1, actuating the removable tube structure 1, which compresses the telescoping tubes of the mandrel assembly 6, and allows the user to orient and position the other stepped shoulder 10 of the telescoping tube mandrel assembly 6, at the tube 2 end of the removable tube structure 1, into the hole 16 of the other leg 15 of the mandrel assembly holder 12, to replace a roll of toilet paper 11, and the telescoping tube mandrel assembly 6, from the mandrel assembly holder 12.

The user removes an empty toilet paper roll 11, with the removable tube structure 1, the telescoping tube mandrel assembly 6 and the mandrel assembly holder 12, by using at least one finger to push the toilet paper roll 11 axially against the radially outward extending plate 3 of the removable tube structure 1, actuating the removable tube structure 1, which compresses the telescoping tubes of the mandrel assembly 6 towards the leg 13 of the mandrel assembly holder 12 that is closer to the plate 3 end of the removable tube structure 1, withdrawing the stepped shoulder 11 of the telescoping tube mandrel assembly 6, at the tube 2 end of the removable tube structure, from the hole 16 in the other leg 15 of the mandrel assembly holder 12, and the user orients the removable tube structure 1, with the empty toilet paper roll 11 and the telescoping tube mandrel assembly 6, at an angle away from the mandrel assembly holder 12, whereby the removable tube structure 1, with the empty toilet paper roll 11 and the telescoping tube mandrel assembly 6 is completely withdrawn from the mandrel assembly holder 12 in order to replace the toilet paper roll 11.

As described above, the structure 1 of the present invention provides multiple advantages over prior and existing similar invention(s), including effortless compression, replacement, installation, and removal of any conventional telescoping tube mandrel assembly 6 and conventional full or empty toilet paper roll 11 from any conventional mandrel assembly holder 12 designed to hold a conventional toilet paper roll.

The structure 1 of the present invention can be modified without affecting the functionality and teaching of the present invention, as long as the shape or geometrical design of the plate 3 and tube 2 of the structure 1 of the present invention, allows for similar engagement of a conventional toilet paper roll 11 to the structure 1 of the present invention to compress a conventional telescoping tube mandrel assembly 6 for installation to, and/or withdrawal from, a conventional mandrel assembly holder.

Additional components can be added to the hole 5 at the tube 2 end of the present invention, to provide an improved fit of the structure 1 of the present invention over a stepped shoulder of the telescoping tube mandrel assembly 6, at the tube 2 end of the present invention.

The scope of the invention is governed by the accompanying claims.

The invention claimed is:

1. A removable tubular structure comprising:

a tube, with a first end and a second end, an inner diameter, and an outer diameter, the outer diameter such that the tube can be inserted into a toilet paper roll to support the toilet paper roll; and a plate, integral with and disposed at the first end of the tube, the plate having an area extending radially outward from the tube; and a first hole, in the center of the plate of the same diameter as the inner diameter of the tube, adapted for removably mounting the tube structure onto, over, and partially enclosing telescoping tubes of a toilet paper roll mandrel assembly; and an inner projection disposed at, and integrally formed with the second end of the tube, the inner projection having a second hole with a diameter less than the inner diameter of the tube, adapted for loose, close, or interference fitment on a shoulder on at least one end of either of the two telescoping tubes of the toilet paper roll mandrel assembly; and a longitudinal direction extending from the second end of the tube to the first end of the tube;

whereby, when the toilet paper roll is either full or empty, a user can grasp and grip the toilet paper roll and push the toilet paper roll in the longitudinal direction such that the toilet paper urges the plate in the longitudinal direction, forcing the inner projection to push on the toilet paper roll mandrel assembly, thereby compressing the toilet paper roll mandrel assembly and allowing for removal of the toilet paper roll mandrel assembly, together with the toilet paper roll and the tube, from a mandrel assembly holder in order to replace the toilet paper roll.

2. The removable tubular structure of claim 1 wherein said plate is of a size allowing for contact or abutment with one end of said toilet paper roll, and said inner projection is of a size allowing for contact or abutment with one end of the mandrel assembly telescoping tubes.

3. The removable tubular structure of claim 1 wherein the removable tubular structure is a tubular partially of a tubular shape or form, of a size allowing for partial insertion into said toilet paper roll.

4. The removable tubular structure of claim 1 wherein the removable tubular structure has a material construction which allows the removable tubular structure to maintain structural integrity during use.

5. The removable tubular structure of claim 1 wherein said inner projection's hole is smaller than said roller mandrel assembly's outer diameter, preventing said roller mandrel assembly from accidentally falling through said tubular structure when said tubular structure is disposed vertically with said plate positioned above said inner projection, whilst a user is holding the toilet paper (full or empty); and said plate is larger than said toilet paper roll's inner diameter, preventing said tubular structure from accidentally falling through said toilet paper roll's inner diameter when said tubular structure is disposed vertically with said plate positioned above said inner projection), whilst a user is holding the toilet paper (full or empty).

6. The removable tubular structure of claim 1 wherein said inner projection is a shape or form that is: round, triangular, square, or rectangular, and of a size allowing for partial insertion of the removable tubular structure into the ends of said toilet paper roll.

* * * * *